US011125248B2

(12) United States Patent
Joshi et al.

(10) Patent No.: US 11,125,248 B2
(45) Date of Patent: Sep. 21, 2021

(54) FAN PERFORMANCE TUNING

(71) Applicant: Toyota Motor Engineering & Manufacturing North America, Inc., Plano, TX (US)

(72) Inventors: Shailesh N. Joshi, Ann Arbor, MI (US); Ercan Mehmet Dede, Ann Arbor, MI (US); Umesh N. Gandhi, Farmington Hills, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 182 days.

(21) Appl. No.: 16/375,436

(22) Filed: Apr. 4, 2019

(65) Prior Publication Data

US 2020/0318651 A1 Oct. 8, 2020

(51) Int. Cl.

| | |
|---|---|
| ***F04D 29/52*** | (2006.01) |
| ***F04D 27/00*** | (2006.01) |
| ***F04D 19/00*** | (2006.01) |

(52) U.S. Cl.

CPC ..... *F04D 29/524* (2013.01); *F04D 27/002* (2013.01); *F04D 19/002* (2013.01)

(58) Field of Classification Search

CPC .... F04D 19/002; F04D 27/002; F04D 29/524; F04D 29/526

See application file for complete search history.

(56) References Cited

U.S. PATENT DOCUMENTS

| | | | |
|---|---|---|---|
| 5,370,340 | A | 12/1994 | Pla |
| 6,299,410 | B1 | 10/2001 | Hilbert et al. |
| 7,064,472 | B2 | 6/2006 | Pelrine et al. |
| 7,538,476 | B2 | 5/2009 | Chrysler et al. |

(Continued)

FOREIGN PATENT DOCUMENTS

| | | |
|---|---|---|
| ES | 2369532 | 12/2011 |
| JP | 2009118645 A | 5/2009 |

OTHER PUBLICATIONS

Duffy et al., "Active Piezoelectric Vibration Control of Subscale Composite Fan Blades", Proceedings of ASME Turbo Expo, Jun. 11-15, 2012, Copenhagen, Denmark (10 pages).

(Continued)

*Primary Examiner* — Woody A Lee, Jr.
(74) *Attorney, Agent, or Firm* — Christopher G. Darrow; Darrow Mustafa PC

(57) ABSTRACT

Fan performance can be adjusted based on real-time operating conditions. The fan can include a plurality of blades operatively connected to a rotor. The blades can extend radially outward from the rotor to a tip. A housing can substantially surround the fan. The housing can have an inner peripheral surface that defines an inner diameter. The inner peripheral surface can include a first portion and a second portion downstream of the first portion. The first portion can be adjacently upstream of the plurality of blades, and the second portion can be substantially aligned with the plurality of blades. A plurality of actuators being distributed in a circumferential direction of the housing. The actuators can be operatively positioned to cause the inner diameter of the first portion or the second portion to be altered. As a result, one or more performance characteristics of the fan can be changed.

20 Claims, 7 Drawing Sheets

(56) References Cited

U.S. PATENT DOCUMENTS

| | | | | |
|---|---|---|---|---|
| 7,608,989 | B2 * | 10/2009 | Heydt | H04R 19/02 310/317 |
| 2007/0098547 | A1 * | 5/2007 | Vinson | F04D 25/0613 415/173.1 |
| 2011/0150669 | A1 | 6/2011 | Frayne et al. | |
| 2017/0239762 | A1 * | 8/2017 | Roberts | F01D 25/24 |
| 2017/0268361 | A1 * | 9/2017 | McCaffrey | F01D 25/246 |
| 2018/0073517 | A1 * | 3/2018 | Pan | F04D 29/386 |
| 2018/0202306 | A1 * | 7/2018 | Hudson | F01D 11/025 |

OTHER PUBLICATIONS

Gupta et al., "An Investigation Of Electroactive Polymer Materials as a Mechanism of Ice Removal", Center for Undergraduate Research and Creative Activities, Undated (1 page).

Duffy et al., "Active Piezoelectric Vibration Control of Subscale Composite Fan Blades", retrieved from the Internet: <https://ntrs.nasa.gov/search.jsp?R=20150010342>, [retrieved Dec. 29, 2018] (21 pages).

Bar-Cohen et al., "Flexible low-mass devices and mechanisms actuated by Electroactive Polymers", SPIE, Newport Beach, CA, 1999 (7 pages).

Roberts et al., "Design and Testing of Braided Composite Fan Case Materials and Components", retrieved from the Internet: <https://ntrs.nasa.gov/search.jsp?R=20090041556>, [retrieved Dec. 29, 2018], Oct. 2009 (18 pages).

Acome et al., "Hydraulically Amplified Self-Healing Electrostatic Actuators with Muscle-Like Performance," Science, vol. 359, Issue 6371, pp. 61-65, Jan. 5, 2018 (6 pages).

Knoss, "Next-gen flexible robots move and heal like us," CU Boulder Today, Jan. 4, 2018, retrieved from the Internet: <https://www.colorado.edu/today/2018/01/04/next-gen-flexible-robots-move-and-heal-us>, [retrieved Mar. 30, 2018] (6 pages).

* cited by examiner

FAN PERFORMANCE TUNING

FIELD

The subject matter described herein relates in general to fans and, more particularly, to the management of fan performance.

BACKGROUND

Fans typically include a fan blade coupled to a motor that is enclosed within a shroud or housing. Air passes through the shroud or housing in a gap between the fan blade and the shroud or housing. The size of this gap affects both fan performance and fan acoustics (e.g., a whistling or humming sound caused by air flowing through the gap).

SUMMARY

In one respect, the present disclosure is directed to a system for fan performance tuning. The system can include a fan. The fan can include a plurality of blades operatively connected to a rotor. The plurality of blades can extend radially outward from the rotor to a tip. The system can include a housing that substantially surrounds the plurality of blades. The housing can define an inner peripheral surface and have an inner diameter. The inner peripheral surface can include a first portion and a second portion. The first portion can be located upstream of the second portion relative to a fluid flow direction of the fan. The first portion can be adjacently upstream of the plurality of blades. The second portion can be substantially aligned with the plurality of blades. The system can include a plurality of actuators. The actuators can be distributed in a circumferential direction of the housing. The plurality of actuators can be operatively positioned to cause the inner diameter of the first portion and/or the second portion to be altered. As a result, one or more performance characteristics of the fan can be changed.

In another respect, the present disclosure is directed to a method of fan performance tuning. The fan can include a plurality of blades operatively connected to a rotor. The blades can extend radially outward from the rotor to a tip. A housing can substantially surround the blades. The housing can define an inner peripheral surface and have an inner diameter. The inner peripheral surface can include a first portion and a second portion. The first portion can be adjacently upstream of the blades, and the second portion can be substantially aligned with the blades. The method can include detecting a fan performance activation condition. The method can include, responsive to detecting a fan performance activation condition, activating one or more of the plurality of actuators to cause the inner diameter of at least one of the first portion or the second portion to decrease. As a result, one or more performance characteristics of the fan can be changed.

DETAILED DESCRIPTION

Arrangements described herein are directed to fan performance tuning. A fan housing can have an inner peripheral surface. Portions of the inner peripheral surface can be configured to be selectively morphable. One of these portions can be located substantially aligned with the plurality of blades of the fan. Another one of these portion can be located adjacently upstream of the plurality of blades. Based on fan operating environment data and/or other factors, actuators can be activated to cause the portions of the inner peripheral surface to morph. As a result, fan performance can be tuned, such as in terms of acoustics and fluid flow.

Figure 1:
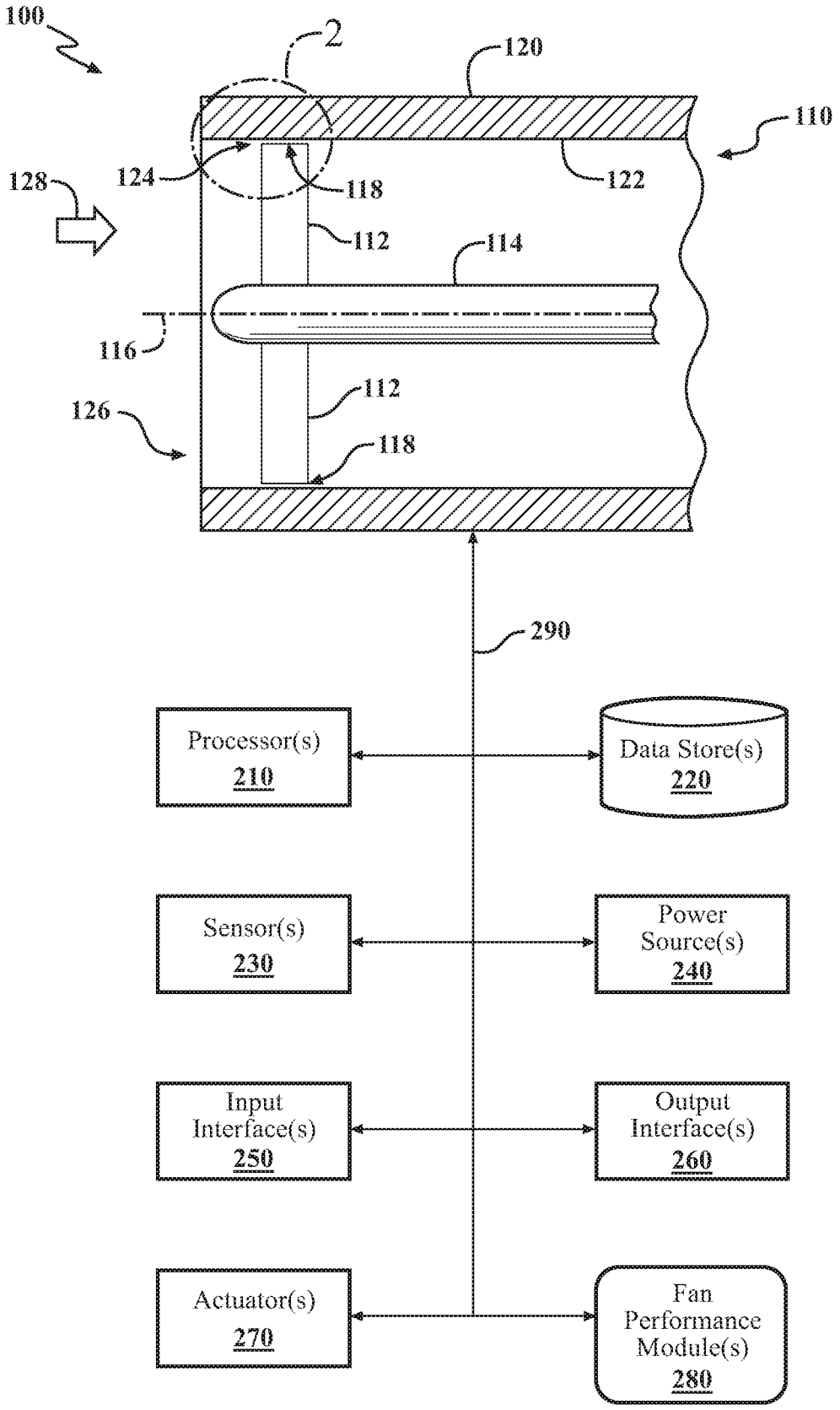
FIG. 1 is an example of a system for fan performance tuning.

Referring to FIG. 1, an example of a system 100 for fan performance tuning is shown. The system 100 can include various elements. Some of the possible elements of the system 100 are shown in FIG. 1 and will now be described. However, it will be understood that it is not necessary for the system 100 to have all of the elements shown in FIG. 1 or described herein. The system 100 can have any combination of the various elements shown in FIG. 1. Further, the system 100 can have additional elements to those shown in FIG. 1. In some arrangements, the system 100 may not include one or more of the elements shown in FIG. 1. Further, the elements shown may be physically separated by large distances.

The system can include a fan system 110, which is shown in a simplified view. The fan system 110 can include a one or more blades 112 operatively connected to a rotor 114. The blades 112 can be directly connected to the rotor 114, or they can be connected to one or more intermediate structures that are connected to the rotor 114. The rotor 114 can have an axis of rotation 116. The blades 112 can extend radially outward from the rotor 114 and terminate in a region known as the blade tip 118. In some instances, the fan system 110 can include one or more stationary airfoils or guide vanes.

The rotor 114 and blades 112 can be enclosed within a casing or housing 120. The housing 120 can include an inner peripheral surface 122. A gap 124 can be defined between the blade tip 118 and the inner peripheral surface 122. The fan system 110 can include an inlet 126 into which air or other fluid is drawn. The fan system 110 can have a flow direction 128.

It will be appreciated that, while the fan system 110 is depicted as being an axial fan system, arrangements described herein are not limited to axial fans. Indeed, the fan system 110 can be used with any other type of fan or turbomachine, now known or later developed. In some arrangements, the fan system 110 can be part of a compressor or a turbine. The fan system 110 may also be part of an electronics or battery cooling system.

In addition to the fan system 110, the system 100 can further include one or more processors 210, one or more data stores 220, one or more sensors 230, one or more power sources 240, one or more input interfaces 250, one or more output interfaces 260, one or more actuators 270, and one or more fan performance modules 280. Each of these elements will be described in turn below.

The system 100 can include one or more processors 210. "Processor" means any component or group of components that are configured to execute any of the processes described herein or any form of instructions to carry out such processes or cause such processes to be performed. The processor(s) 210 may be implemented with one or more general-purpose and/or one or more special-purpose processors. Examples of suitable processors include microprocessors, microcontrollers, DSP processors, and other circuitry that can execute software. Further examples of suitable processors include, but are not limited to, a central processing unit (CPU), an array processor, a vector processor, a digital signal processor (DSP), a field-programmable gate array (FPGA), a programmable logic array (PLA), an application specific integrated circuit (ASIC), programmable logic circuitry, and a controller. The processor(s) 210 can include at least one hardware circuit (e.g., an integrated circuit) configured to carry out instructions contained in program code. In arrangements in which there is a plurality of processors 210, such processors can work independently from each other or one or more processors can work in combination with each other.

The system 100 can include one or more data stores 220 for storing one or more types of data. The data store(s) 220 can include volatile and/or non-volatile memory. Examples of suitable data stores 220 include RAM (Random Access Memory), flash memory, ROM (Read Only Memory), PROM (Programmable Read-Only Memory), EPROM (Erasable Programmable Read-Only Memory), EEPROM (Electrically Erasable Programmable Read-Only Memory), registers, magnetic disks, optical disks, hard drives, or any other suitable storage medium, or any combination thereof. The data store(s) 220 can be a component of the processor(s) 210, or the data store(s) 220 can be operatively connected to the processor(s) 210 for use thereby. The data store(s) 220 can store information about any of the elements of the system 100, such as the fan system 110. In one or more arrangements, the data store(s) 220 can store fan performance data, such as static pressure curves, brake horsepower curves, system lines, or any other type of fan performance data in any form, now known or later developed. In one or more arrangements, the data store(s) 220 can store fan performance thresholds and/or profiles. For instance, the data store(s) 220 can store profiles of unwanted acoustic signatures or patterns.

The system 100 can include one or more sensors 230. "Sensor" means any device, component and/or system that can detect, determine, assess, monitor, measure, quantify and/or sense something. The one or more sensors 230 can detect, determine, assess, monitor, measure, quantify and/or sense in real-time. As used herein, the term "real-time" means a level of processing responsiveness that a user, entity, component, and/or system senses as sufficiently immediate for a particular process or determination to be made, or that enables a processor to process data at substantially the same rate as some external process or faster.

In arrangements in which there are a plurality of sensors 230, the sensors 230 can work independently from each other. Alternatively, two or more of the sensors 230 can work in combination with each other. In such case, the two or more sensors 230 can form a sensor network. The sensor(s) 230 can be operatively connected to the processor(s) 210, the data store(s) 220, and/or other element of the system 100 (including any of the elements shown in FIG. 1). The sensor(s) 230 can acquire data of at least a portion of the system 100.

The sensor(s) 230 can include any suitable type of sensor. For instance, the sensor(s) 230 can include one or more sensors configured to detect, measure, or acquire data about one or more acoustic characteristics of the fan system 110. Non-limiting examples of such acoustic characteristics include frequency, amplitude, wavelength, pressure, temperature, etc. In one or more arrangements, the sensor(s) 230 can include one or more microphones or pressure transducers. The microphone(s) can be any type of microphone, now know or later developed. In some instances, the sensor(s) 230 can be configured to acquire data indicative of undesired noises in the fan system 110, such as tonal noise (e.g. whistling or noises associated with the blade passing frequency) and broadband noise (e.g. humming).

Further, the sensor(s) 230 can include one or more sensors configured to measure one or more fluid flow characteristics of the fan system 110. For example, the sensor(s) 230 can include volumetric flow rate sensors or mass flow sensors. Still further, the sensor(s) 230 can include one or more sensors configured to measure one or more pressure characteristics of the fan system 110. For example, the sensor(s) 230 can include pressure sensors, pressure gauges, and/or transducers. Such sensors can be configured to measure static pressure, dynamic, differential, and/or total pressure of the fan system 110.

As noted above, the system 100 can include one or more power sources 240. The power source(s) 240 can be any power source capable of and/or configured to energize the actuators 270. For example, the power source(s) 240 can include one or more batteries, one or more fuel cells, one or more generators (e.g. piezoelectric), one or more alternators, one or more solar cells, and combinations thereof. In some arrangements, the power source(s) 240 can be configured to supply positively charged electrical energy and/or negatively charged electrical energy.

The system 100 can include one or more input interfaces 250. An "input interface" includes any device, component, system, element or arrangement or groups thereof that enable information/data to be entered into a machine. The input interface(s) 250 can receive an input from a user (e.g., a person) or other entity. Any suitable input interface(s) 250 can be used, including, for example, a keypad, display, touch screen, multi-touch screen, button, joystick, mouse, trackball, microphone, gesture recognition (radar, lidar, camera, or ultrasound-based), and/or combinations thereof.

The system 100 can include one or more output interfaces 260. An "output interface" includes any device, component, system, element or arrangement or groups thereof that enable information/data to be presented to a user (e.g., a person) or other entity. The output interface(s) 260 can present information/data to a user or other entity. The output interface(s) 260 can include a display, an earphone, haptic device, and/or speaker. Some components of the system 100 may serve as both a component of the input interface(s) 250 and a component of the output interface(s) 260.

The system 100 can include one or more actuators 270. The actuators 270 will be described in greater detail below in connection with FIGS. 2-9. The actuators 270 can be used at various locations in the fan system 110, as will be described in greater detail below.

The system 100 can include one or more modules. The modules can be implemented as computer readable program code that, when executed by a processor, implement one or more of the various processes described herein. One or more of the modules can be a component of the processor(s) 210, or one or more of the modules can be executed on and/or distributed among other processing systems to which the processor(s) 210 is operatively connected. The modules can include instructions (e.g., program logic) executable by one or more processor(s) 210. Alternatively or in addition, one or more data stores 220 may contain such instructions. The modules described herein can include artificial or computational intelligence elements, e.g., neural network, fuzzy logic or other machine learning algorithms. Further, the modules can be distributed among a plurality of modules.

The system 100 can include one or more fan performance modules 280. The fan performance module(s) 280 can include profiles and logic for actively controlling the actuators 270 according to arrangements herein. The fan performance module(s) 280 can be configured to determine when the actuators 270 should be activated or deactivated. The fan performance module(s) 280 can be configured to do so in any suitable manner. For instance, the fan performance module(s) 280 can be configured to analyze data or information acquired by the sensor(s) 230. Alternatively or additionally, the fan performance module(s) 280 can be configured to detect user inputs (e.g., commands) provided on the input interface(s) 250. The fan performance module (s) 280 can retrieve raw data from the sensor(s) 230 and/or from the data store(s) 220. The fan performance module(s) 280 can use profiles, parameters, or setting loaded into the fan performance module(s) 280 and/or stored in the data store(s) 220.

The fan performance module(s) 280 can analyze the sensor data to determine an appropriate action for the actuators 270. The fan performance module(s) 280 can be configured to cause one or more actuators 180 to be activated or deactivated. As used herein, "cause" or "causing" means to make, force, compel, direct, command, instruct, and/or enable an event or action to occur or at least be in a state where such event or action may occur, either in a direct or indirect manner. For instance, the fan performance module(s) 280 can selectively permit or prevent the flow of electrical energy from the power source(s) 240 to the actuators 270. The fan performance module(s) 280 can be configured send control signals or commands over a communication network to the actuators 270.

The fan performance module(s) 280 can be configured to cause the actuators 270 to be selectively activated or deactivated based on one or more fan performance activation parameters. For instance, the fan performance module(s) 280 can be configured to compare acquired data to one or more thresholds or acoustic profiles. If a threshold or profile is met, then the fan performance module(s) 280 can cause the actuators 270 to be activated or maintained in an activated condition. If the threshold is not met, then the fan performance module(s) 280 can cause the actuators 270 to be deactivated or maintained in a deactivated or non-activated state.

For instance, there can be an acoustic threshold. In one or more arrangements, the acoustic threshold can be a single acoustic parameter (e.g., amplitude, frequency, wavelength, etc.) or a plurality of acoustic parameters. If acquired acoustic data exceeds the acoustic threshold, the fan performance module(s) 280 can be configured to cause the actuators 270 to be activated or maintained in an activated state. If acquired acoustic data is below the acoustic threshold, the fan performance module(s) 280 can be configured to cause the actuators 270 to be deactivated or maintained in a deactivated state.

As another example, there can be an acoustic profile. In some arrangements, the acoustic profile can be one or more acoustic patterns indicative of unwanted noise in the fan system 110. If the acquired acoustic data substantially matches an acoustic profile, then the fan performance module(s) 280 can be configured to cause the actuators 270 to be activated or maintained in an activated state. If acquired acoustic data does not substantially match an acoustic profile, the fan performance module(s) 280 can be configured to cause the actuators 270 to be deactivated or maintained in a deactivated state.

As another example, there can be a fluid flow threshold, such as a fluid flow threshold. If the acquired fluid flow data is above the fluid flow threshold or falls outside of a fluid flow range, the fan performance module(s) 280 can be configured to cause the actuators 270 to be activated or maintained in an activated state. If the acquired fluid flow data is below the fluid flow threshold or within a fluid flow range, the fan performance module(s) 280 can be configured to cause the actuators 270 to be deactivated or maintained in a deactivated state.

In one or more arrangements, the fan performance module (s) 280 can be configured to cause the actuators 270 to be selectively activated or deactivated based on both an acoustic profile/threshold and a fluid flow threshold.

In some instances, the fan performance module(s) 280 can be configured to cause the actuators 270 to be selectively activated or deactivated based on user inputs (e.g., commands). For instance, a user can provide an input on the input interface(s) 250. The input can be to activate or deactivate the actuators 270. The fan performance module(s) 280 can be configured to cause the actuators 270 to be deactivated or activated in accordance with the user input.

The various elements of the system 100 can be communicatively linked to one another or one or more other elements through one or more communication networks 290. As used herein, the term "communicatively linked" can include direct or indirect connections through a communication channel, bus, pathway or another component or system. A "communication network" means one or more components designed to transmit and/or receive information from one source to another. The data store(s) 220 and/or one or more other elements of the system 100 can include and/or execute suitable communication software, which enables the various elements to communicate with each other through the communication network and perform the functions disclosed herein.

The one or more communication networks 290 can be implemented as, or include, without limitation, a wide area network (WAN), a local area network (LAN), the Public Switched Telephone Network (PSTN), a wireless network, a mobile network, a Virtual Private Network (VPN), the Internet, a hardwired communication bus, and/or one or more intranets. The communication network 290 further can be implemented as or include one or more wireless networks, whether short range (e.g., a local wireless network built using a Bluetooth or one of the IEEE 802 wireless communication protocols, e.g., 802.11a/b/g/i, 802.15, 802.16, 802.20, Wi-Fi Protected Access (WPA), or WPA2) or long range (e.g., a mobile, cellular, and/or satellite-based wireless network; GSM, TDMA, CDMA, WCDMA networks or the like). The communication network can include wired communication links and/or wireless communication links. The communication network can include any combination of the above networks and/or other types of networks.

Figure 2:
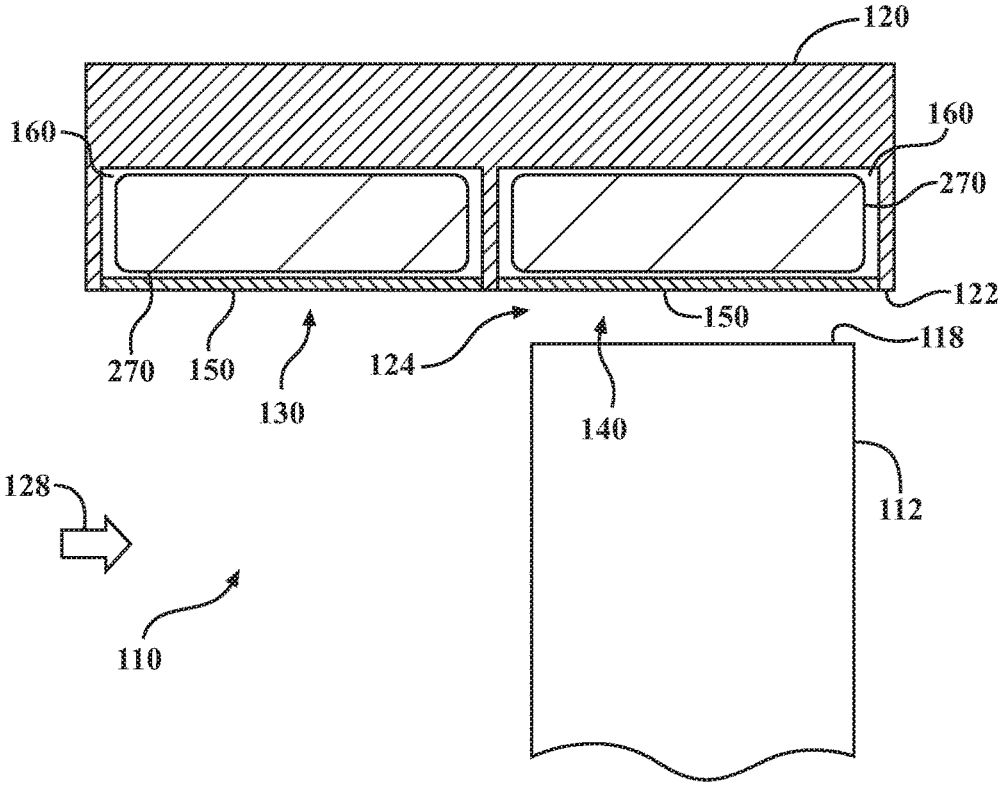
FIG. 2 is a close-up view of a portion of a fan system, showing an example of an interface between a fan blade and a housing and showing actuators in a non-activated condition.

Referring to FIG. 2, a cross sectional view of a portion of the fan system 110 is shown. The inner peripheral surface 122 of the housing 120 can include a first portion 130 and a second portion 140. The first portion 130 can be located upstream of the second portion 140 relative to the flow direction 138. The first portion 130 be substantially adjacent to the second portion 140. "Substantially adjacent" includes instances in which the first portion 130 and the second portion directly border each other as well as instances in which the first portion 130 is spaced from the second portion 140 (e.g., by 6 inches or less, 5 inches or less, 4 inches or less, 3 inches or less, 2 inches or less, 1 inch or less, or 0.5 inches or less).

The first portion 130 can be adjacently upstream of the plurality of blades 112. "Adjacently upstream" includes instances in which the downstream-most portion of the first portion 130 is located within a plane that directly borders the blades 112 or is slightly spaced from the blades 112 (e.g., by 6 inches or less, 5 inches or less, 4 inches or less, 3 inches or less, 2 inches or less, 1 inch or less, or 0.5 inches or less). The second portion 140 can be substantially aligned with the plurality of blades 112. In this context, "substantially aligned" includes instances in which the second portion 140 substantially surrounds at least a portion of the row of blades 112, substantially surrounds a majority of row of the blades 112, or entirely surrounds the row of blades 112.

A plurality of actuators 270 for each of the portions 130, 140 can be distributed in a circumferential direction of the housing 120. The plurality of actuators 270 can be configured to and/or operatively positioned to cause the inner diameter of at least one of the first portion or the second portion to be altered. As a result, one or more performance characteristics (e.g., static pressure, air flow, frequency, etc.) of the fan system 110 can be changed.

In one or more arrangements, the actuators 270 can be located within a recess 160 or a passage in the housing 120. It should be noted that there can be a single recess 160 that extends in the circumferential direction of the housing 120. Alternatively, there can be a plurality of recesses that are distributed in the circumferential direction of the housing 120. Further, while FIG. 2 shows that the actuators 270 for the first portion 130 and the second portion 140 are located in separate recesses 160, it will be appreciated that there may be a single recess that received both the actuators 270 for both the first portion 130 and the second portion 140. In some arrangements, the actuators 270 can be operatively connected to a portion of the recess 160. In other arrangements, the actuators 270 may not be connected to a portion of the recess 160

The recess 160 or passage can open to the inner peripheral surface 122 of the housing 120. In some arrangements, a covering 150 can substantially cover the opening of the recess 160 or passage. In this way, the covering 150 can define a portion of the inner peripheral surface 122 of the housing 120. The covering 150 can prevent the actuators 270 from being exposed to the operating environment of the fan system 110.

The covering 150 can be made of any suitable material. In one or more arrangements, the covering 150 can be made of a flexible or compliant material. In one or more arrangements, the flexible material can be made of plastic. In one or more arrangements, the covering 150 can be attached to any suitable portion of the housing 120, such as within the recess 160 or passage. Any suitable form of attachment can be used such as one or more fasteners, one or more adhesives, and/or one or more forms of mechanical engagements, just to name a few possibilities. The covering 150 may be additively manufactured out of multiple materials to create a functionally-graded surface, where a first portion is rigid for mechanical attachment and a second portion is compliant to cover the actuators 270. The covering 150 can be configured to stretch when the actuators 270 are activated, and the covering 150 can be configured to substantially return to its non-stretched configuration with the actuators 270 are deactivated.

Figure 3:
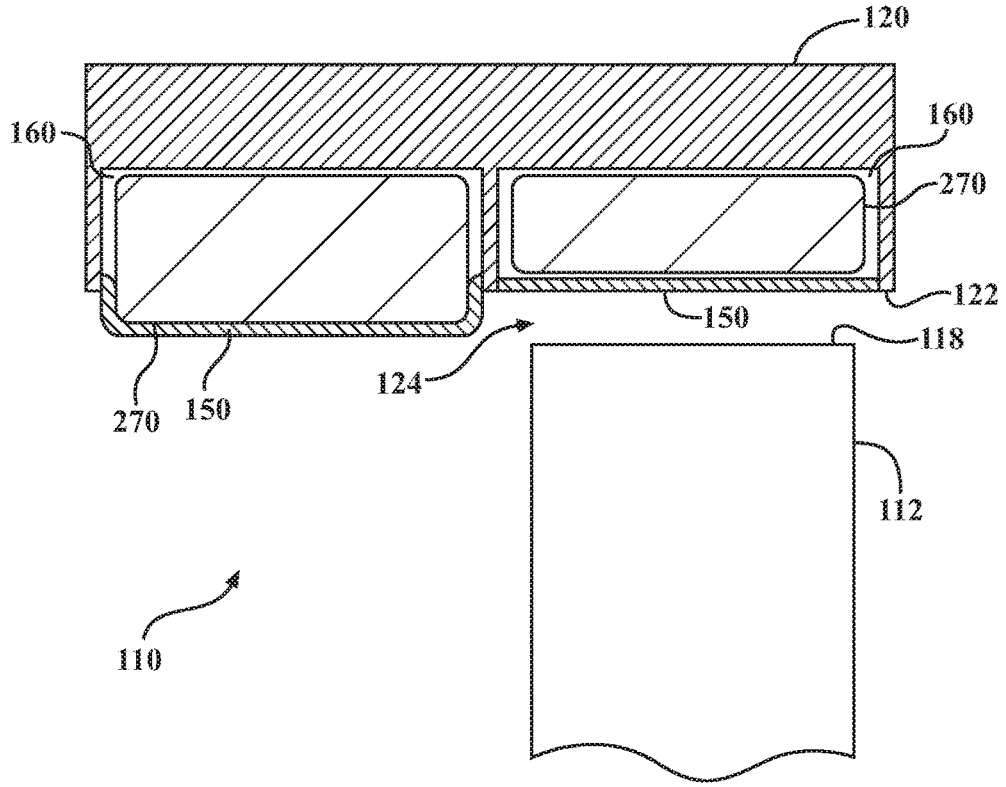
FIG. 3 is a close-up view of a portion of a fan system, showing an example of an interface between a fan blade and showing the actuators located upstream of the fan blade in an activated condition.
Figure 4:
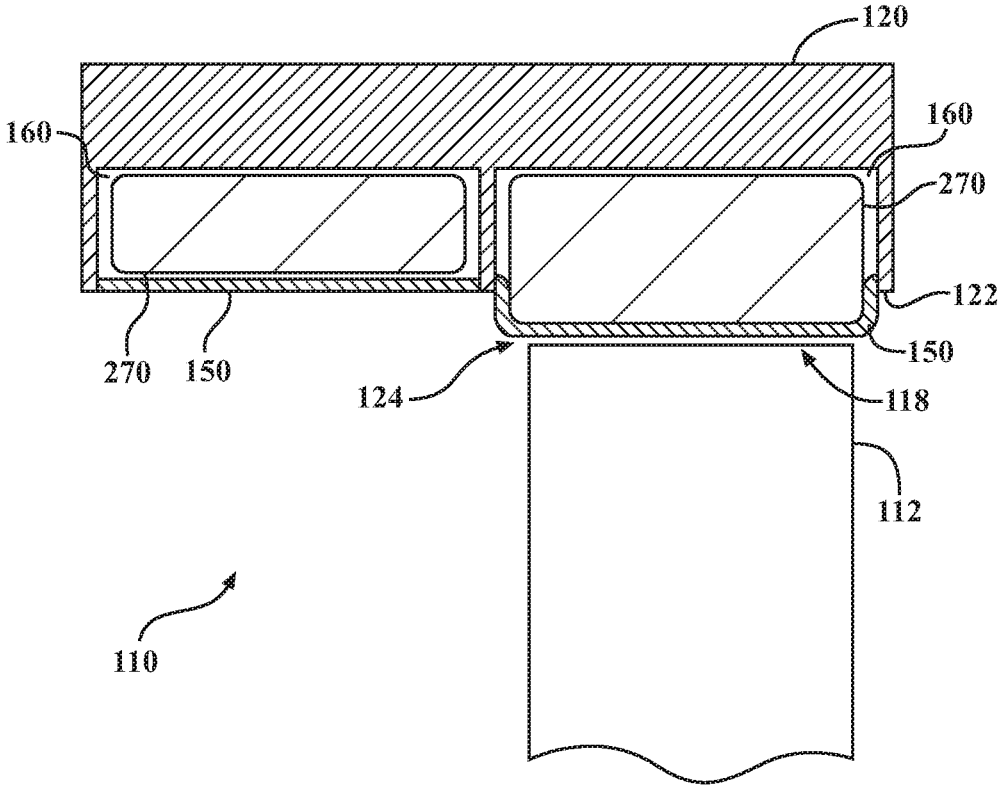
FIG. 4 is a close-up view of a portion of a fan system, showing an example of an interface between a fan blade and showing the actuators located in line with the fan blade in an activated condition.
Figure 5:
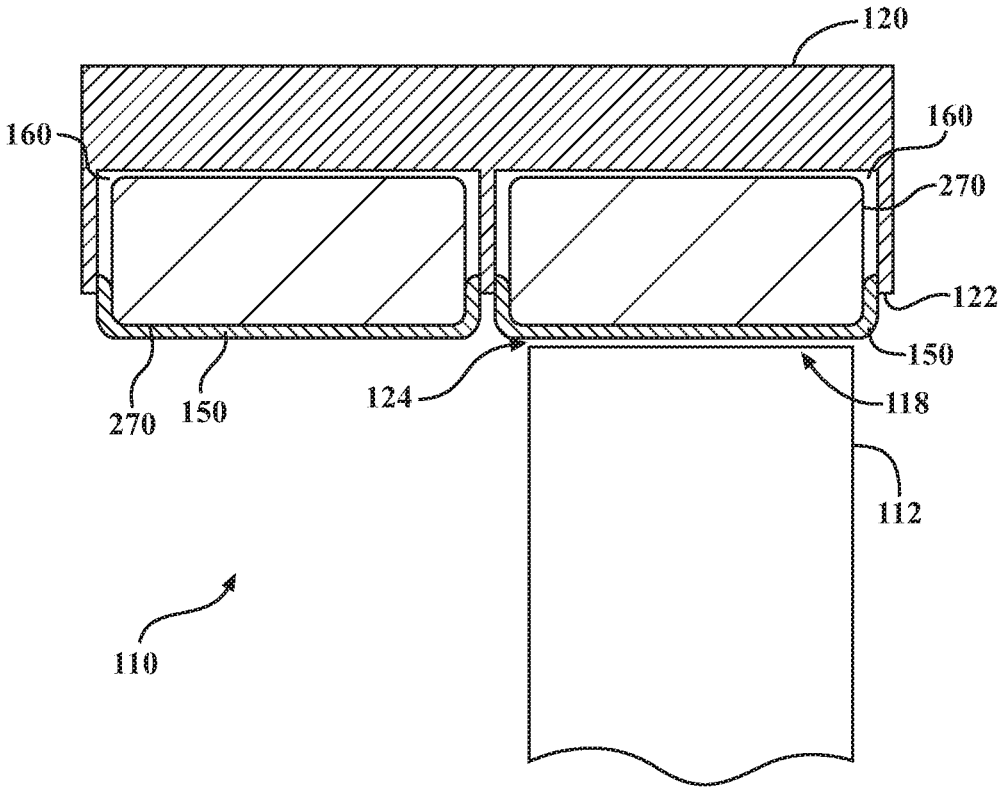
FIG. 5 is a close-up view of a portion of a fan system, showing an example of an interface between a fan blade and showing the actuators located upstream of the fan blade in an activated condition and the actuators located in line with the fan blade in an activated condition.

In one or more arrangements, the actuators 270 associated with the first portion 130 and the actuators 270 associated with the second portion 140 can be independently actuated. FIGS. 3-5 show various activated conditions. For instance, in FIG. 4, the actuators 270 associated with the first portion 130 can be activated, and the actuators 270 associated with the second portion 140 are not activated. When the actuators 270 associated with the first portion 13 are activated, the inner diameter of the housing 120 at that location decreases. In FIG. 5, the actuators 270 associated with the second portion 140 can be activated, but the actuators 270 associated with the first portion 130 are not activated. When the actuators 270 associated with the second portion 140 are activated, the inner diameter of the housing 120 at that location decreases. As a result, the size of the gap 124 can decrease. In FIG. 6, the actuators 270 associated with the first portion 130 can be activated, and the actuators 270 associated with the second portion 140 are activated.

It will be appreciated that, when the actuators 270 are activated, they can extend in a radially inward direction. The actuators 270 may achieve any arbitrary shape profile for the diameter of the inner surface of the housing. As a result, the diameter of the inner peripheral surface in a given location will decrease. The actuators 270 can be configured to have a maximum extended position. It will be appreciated that the actuators can be activated to this maximum extended position or to an extended position that is less than the maximum extended position. Further, it will be appreciated that the activated actuators 270 can cause the covering 150 to stretch. When deactivated, the covering can substantially return to the non-activated configuration.

Further, it will be noted that the arrangements shown in FIGS. 2-5 are merely examples. In some arrangements, the actuators 270 associated with the first portion 130 and the second portion 140 can be activated substantially simultaneously. Further, in some arrangements, there can be more than two portions. For instance, there can be three, four, or five portions. Still further, in some arrangements, there may only be one portion. In such case, the single portion can correspond to the first portion 130 or the second portion 140 described above. In some arrangements, the single portion can cover at least some of the first portion 130 and at least some of the second portion 140 as described above. It will be appreciated that, in some fan systems, there may be a plurality of rows of blades. In such case, arrangements described herein can be used in connected with all rows of blades, or arrangements can be used in connection with any subset of the rows of blades.

While FIGS. 2-5 are shown and described with respect to a general actuator, it will be appreciated that a variety of actuators can be used according to arrangements described herein. Some non-limiting examples of suitable actuators will be described in turn below.

Figure 6A:
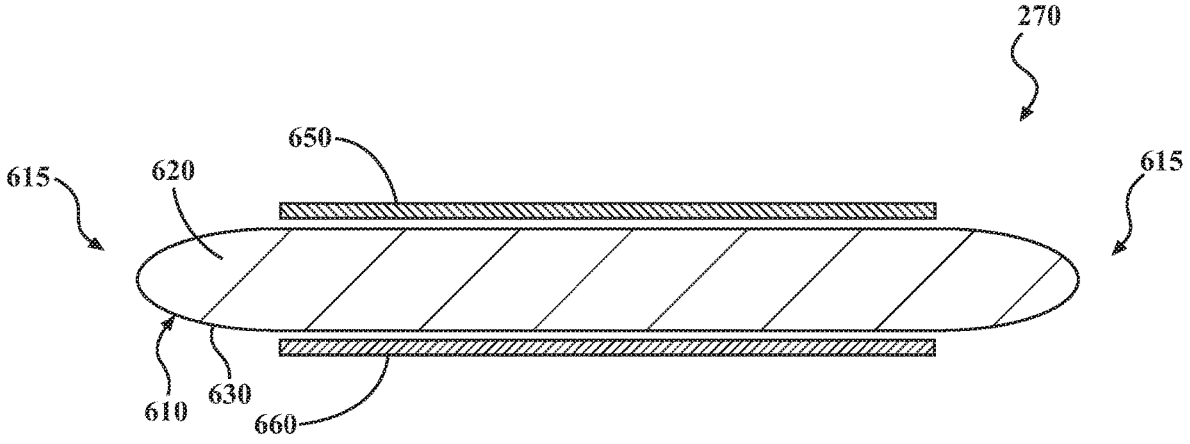
FIG. 6A is an example of an actuator, showing a non-activated condition.
Figure 6B:
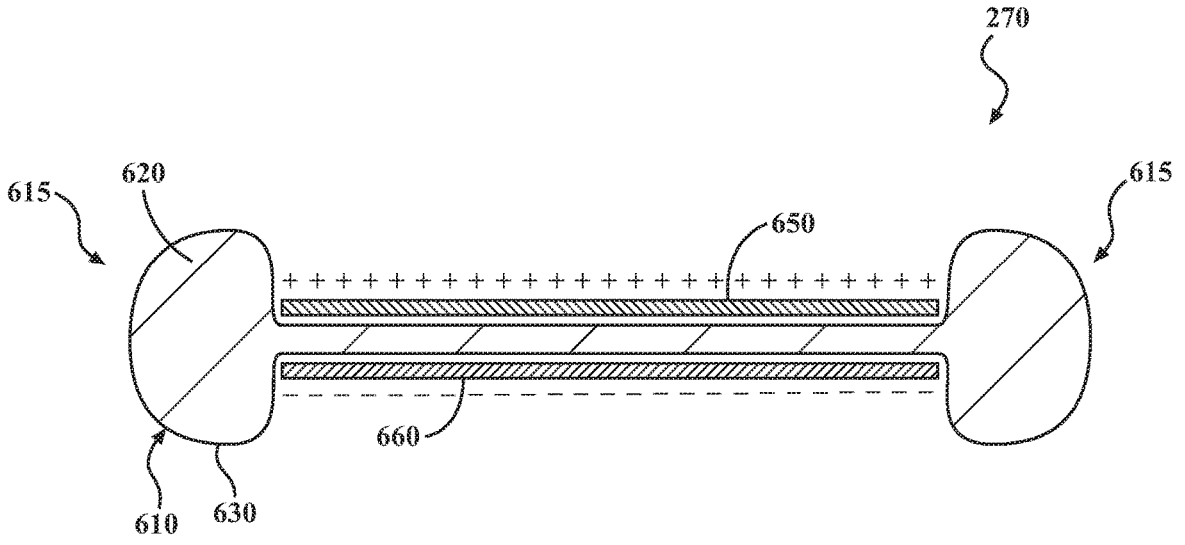
FIG. 6B is an example of the actuator, showing an activated condition.

Referring to FIGS. 6A-6B, a cross-sectional view of an example of an example of an actuator 270 is shown. The actuator 270 can have a body that is, at least in large part, made of a soft, flexible material. The actuator 270 can include a bladder 610 containing a dielectric fluid 620. The bladder 610 can include a casing 630. The casing 630 can be made of a single piece of material, or a plurality of separate pieces of material that are joined together. An inner surface of the casing 630 can define a fluid chamber. In one or more arrangements, the bladder 610 and/or fluid chamber can be fluid impermeable.

The bladder 610 can be made of any suitable material. For example, the bladder 610 can be made of an insulating material. The insulating material can be flexible. The insulating material can be a polymer and/or an elastomeric polymer (elastomer). The polymers or elastomers can be natural or synthetic in nature. In one or more arrangements, the insulating material can be silicone rubber. Additional examples of the insulating material include nitrile, ethylene propylene diene monomer (EPDM), fluorosilicone (FVMQ), vinylidene fluoride (VDF), hexafluoropropylene (HFP), tetrafluoroethylene (TFE), perfluoromethylvinylether (PMVE), polydimethylsiloxane (PDMS), natural rubber, neoprene, polyurethane, silicone, or combinations thereof.

A dielectric fluid 620 can be any suitable material. In one or more arrangements, the dielectric fluid 620 can be ethylene glycol or air. As an additional example, the dielectric fluid 620 can include transformer oil or mineral oil. In one or more arrangements, the dielectric fluid 620 can be a lipid based fluid, such as a vegetable oil-based dielectric fluid.

The dielectric fluid 620 can have various associated properties. The dielectric fluid 620 can have an associated dielectric constant. In one embodiment, the dielectric fluid 620 can have a dielectric constant of 1 or greater, 2 or greater, 3 or greater, 4 or greater, 5 or greater, 6 or greater, 7 or greater, 8 or greater, 9 or greater, 10 or greater, 20 or greater, 30 or greater, 40 or greater, 50 or greater, or higher. The dielectric constant of the dielectric fluid 620 can be selected based on various factors, such as geometry and/or voltage, just to name a few possibilities.

In one or more arrangements, the dielectric fluid 620 can be a fluid that is resistant to electrical breakdown. In one or more arrangements, the dielectric fluid 620, can provide electrical insulating properties. In one or more arrangements, the dielectric fluid 620 can prevent arcing between surrounding conductors.

The actuator 270 can include a plurality of conductors. In the example shown in FIGS. 6A-6B, the actuator 270 can include a first conductor 650 and a second conductor 660. The conductors 650, 660 can conduct electrical energy. The conductors 650, 660 can be made of any suitable material, such as a conductive elastomer. In one or more arrangements, the conductors 650, 660 can be made of natural rubber with carbon or other conductive particles distributed throughout the material. The conductors 650, 660 can be made of the same material as each other, or the conductors 650, 660 can be made of different materials. One or more of the conductors 650, 660 can be formed by a single, continuous structure, or one or more of the conductors 650, 660 can be formed by a plurality of separate structures.

The first conductor 650 and the second conductor 660 can be located on opposite sides or portions of the bladder 610. Thus, the first conductor 650 and the second conductor 660 can be separated by the bladder 610. The first conductor 650 and/or the second conductor 660 can be operatively connected to the bladder 610 in any suitable manner. In some instances, the first conductor 650 and/or the second conductor 660 can be embedded within a wall of the bladder 610. In one or more arrangements, the first conductor 650 can be operatively positioned between the bladder 610 and an insulating material. In such case, the first conductor 650 can be substantially encapsulated by the bladder 610 and the insulating material. Also, the second conductor 660 can be operatively positioned between the bladder 610 and an insulating material. In one or more arrangements, the second conductor 660 can be substantially encapsulated by the bladder 610 and the insulating material. In one or more arrangements, the insulating material can be made of an insulating elastomer. Thus, it will be appreciated that, at least in some instances, the insulating material can define exterior surfaces of the actuator 270.

Each of the conductors 650, 660 can be operatively connected to receive electrical energy from a power source (e.g., the power source(s) 240). As a result, electrical energy can be selectively supplied to each individual conductors 650, 660.

The actuator 270 can have a non-activated mode and an activated mode. Each of these modes will be described in turn. FIG. 6A shows an example of a non-activated mode of the actuator 270. In such case, electrical energy is not supplied to the first conductor 650 and the second conductor 660. Thus, the first conductor 650 and the second conductor 660 can be spaced apart from each other. The bladder 610 can be in a neutral state. In some instances, a portion of the bladder 610 can extend beyond the outer edges of the first conductor 650 and the second conductor 660.

FIG. 6B shows an example of an activated mode of the actuator 270. In the actuated mode, power can be supplied to the first conductor 650 and the second conductor 660. In one implementation, the first conductor 650 can become positively charged and the second conductor 660 can become negatively charged. Thus, the first conductor 650 and the second conductor 660 can be oppositely charged. As a result, the first conductor 650 and the second conductor 660 can be attracted toward each other. The attraction between the first conductor 650 and the second conductor 660 can cause them and the respective portions of the bladder 610 to move toward each other. As a result, at least a portion of the dielectric fluid 620 within the fluid chamber can be squeezed toward the outer peripheral region(s) 615 of the bladder 610. In at least some instances, the outer peripheral region(s) 615 of the bladder 610 can bulge, as is shown in FIG. 6B. As the result, the outer peripheral region(s) 615 of the bladder 610 may increase the overall height of the actuator 270 (in the top to bottom direction on the page).

It will be appreciated that there can be other configurations for the actuator 270. For example, in another configuration, the first conductor 650 and/or the second conductor 660 can be shaped with a central opening. In such case, when the actuator is activated, the first conductor 650 and/or the second conductor 660 move toward each other such that the bladder 610 is pushed through the central opening, thereby increasing the overall height of the actuator.

Figure 7A:
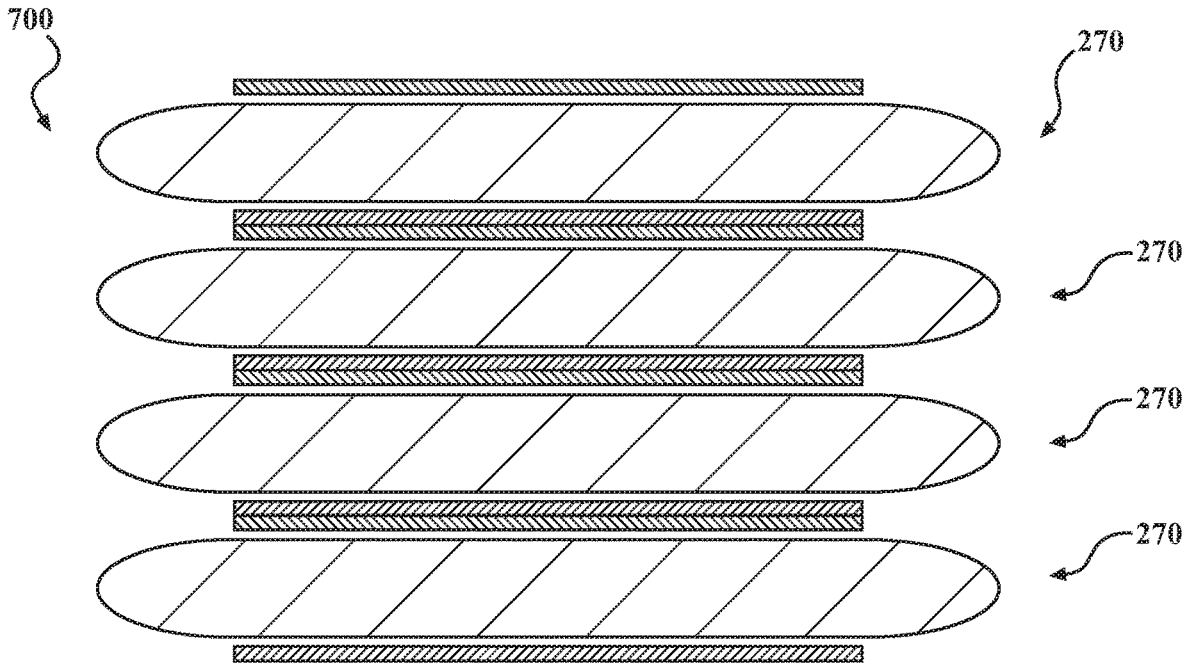
FIG. 7A is an example of an actuator stack, showing a non-activated condition.
Figure 7B:
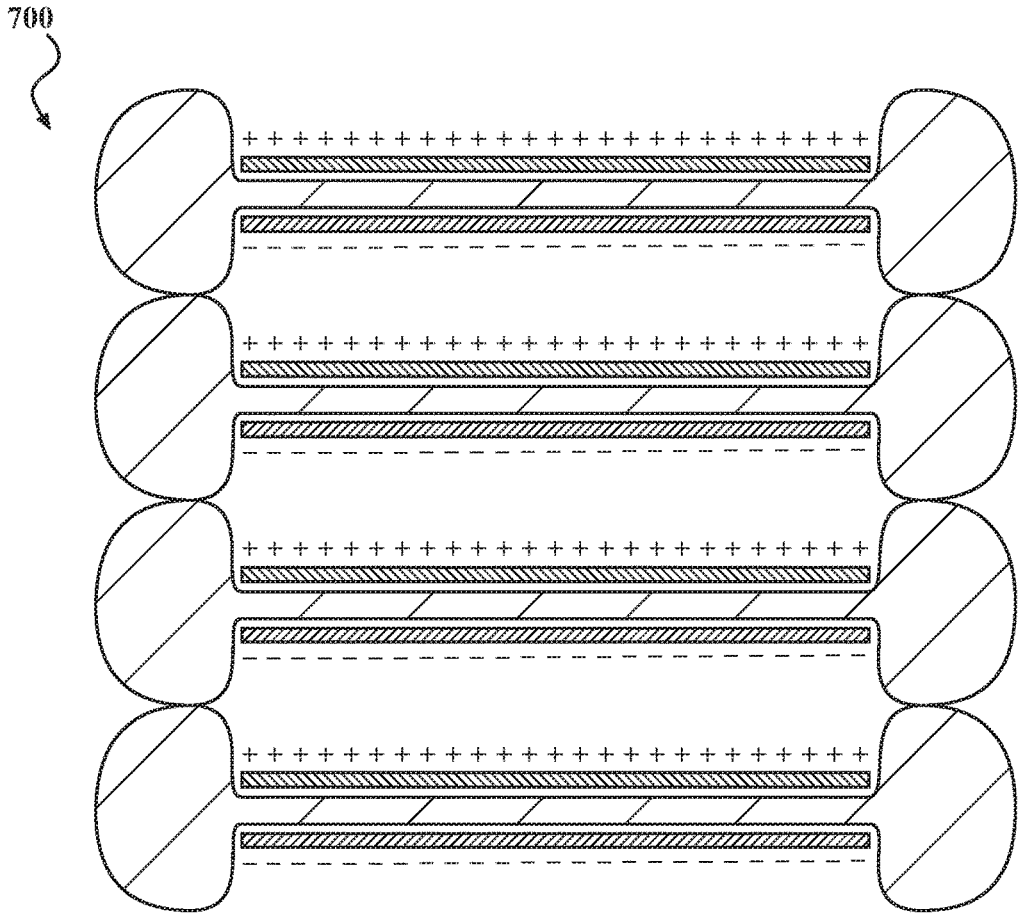
FIG. 7B is an example of the actuator stack, showing an activated condition.

Turning now to FIGS. 7A-7B, an example of a plurality of actuators 270 arranged in an actuator stack 700 is shown. FIG. 7A shows the actuator stack 700 in a non-actuated mode. FIG. 7B shows the actuator stack 700 in an actuated mode. The above-description of the actuator 270 in connection with FIGS. 6A-6B applies equally to the individual actuators 270 in the actuator stack 700. It will be appreciated that, in going from the non-actuated mode to the actuated mode, the overall height (the top to bottom direction on the page) of the actuator stack 700 can increase. In such arrangements, it will be appreciated that the actuators 270 in the actuator stack 700 can be actuated individually or two or more of the actuators 270 can be actuated at the same time. Neighboring actuators 270 in the actuator stack 700 can be separated from each other by an insulating layer. In some instances, such an insulating layer can operatively connect the neighboring actuators 270 together.

Figure 8A:
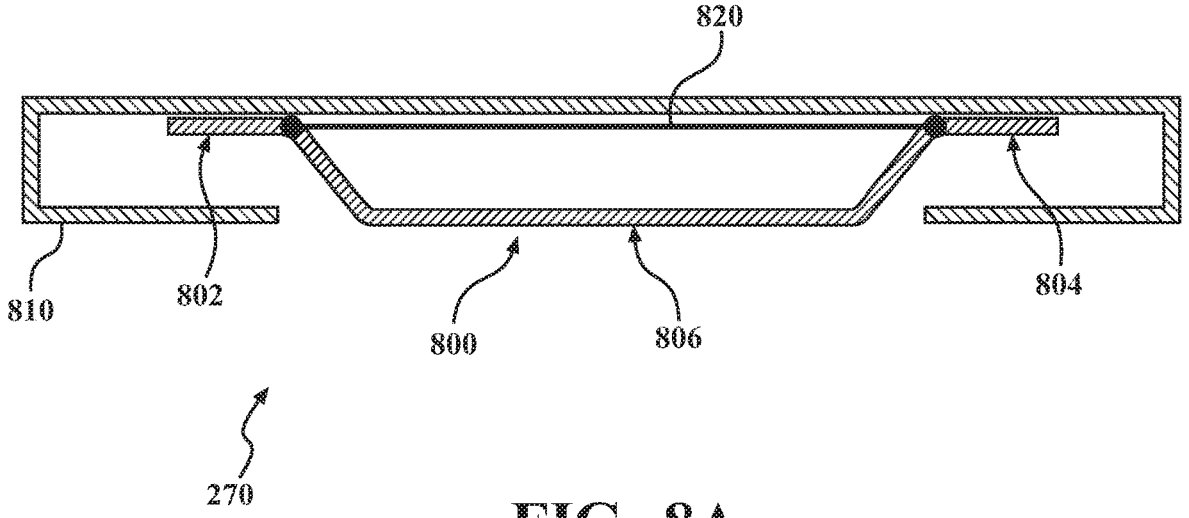
FIG. 8A is an example of an actuator, showing a non-activated condition.
Figure 8B:
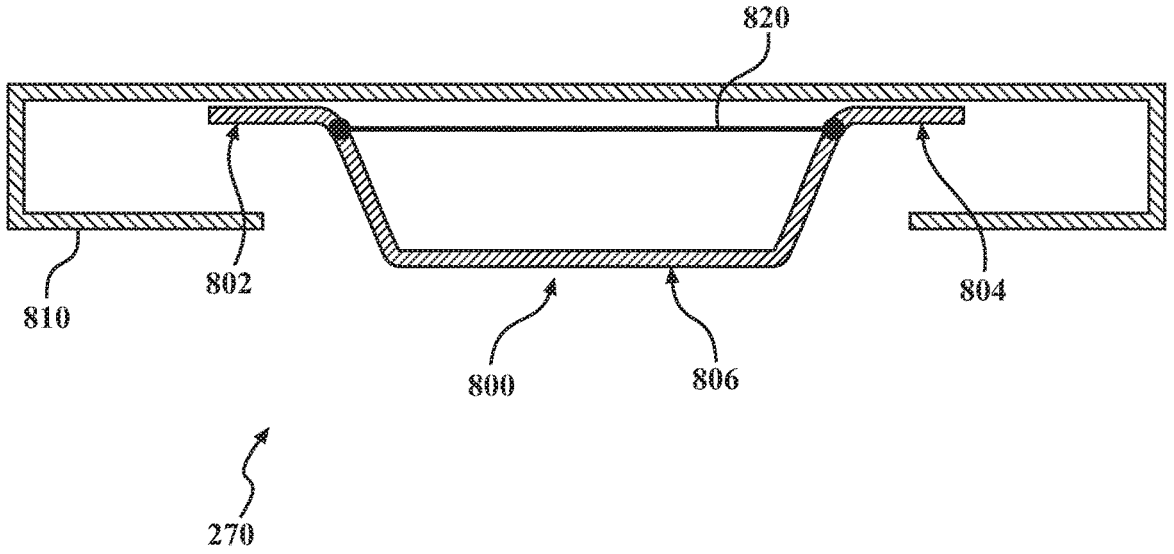
FIG. 8B is an example of the actuator, showing an activated condition.

Referring to FIGS. 8A-8B, a cross-sectional view of another example of an actuator 270 is shown. The actuator 270 can include a sheet 800 made of a flexible or compliant material. The sheet 800 can be a plastic sheet. The sheet 800 can include a first end portion 802 and a second end portion 804. The sheet 800 can include a central portion 806 between the first end portion 802 and the second end portion 804. The sheet 800 can be configured so that the central portion 806 is offset from the first end portion 802 and the second end portion 804. In some arrangements, the first end portion 802 can be substantially aligned with the second end portion 804.

The actuator 270 can include a frame 810. In one or more arrangements, the frame 810 can be a separate element that is provided within the housing 120. Alternatively, the frame 810 can be defined by the housing 120 itself. The frame 810 can include an opening 812. In some arrangements, the first end portion 802 and the second end portion 804 can be operatively connected to the frame 810, such as by one or more fasteners, one or more adhesives, and/or one or more forms of mechanical engagement.

The actuator 270 can include a shape memory material member 820. The ends of the shape memory material member 820 can be operatively connected to different portions of the sheet 800. In one or more arrangements, one end of the shape memory material member 820 can be operatively connected to the first end portion 802, a transition region of the sheet 800 between the first end portion 802 and the central portion 806, or to the central portion 806 proximate the first end portion 802. In one or more arrangements, the other end of the shape memory material member 820 can be operatively connected to the second end portion 804, a transition region of the sheet 800 between the second end portion 804 and the central portion 806, or to the central portion 806 proximate the second end portion 804. The shape memory material member 820 can be operatively connected to these structures in any suitable manner, including by one or more fasteners, one or more adhesives, one or more welds, and/or one or more forms of mechanical engagement, just to name a few possibilities.

The actuator 270 can have a non-activated configuration and an activated configuration. Each of these configurations will be described in turn. FIG. 8A shows an example of a non-activated configuration of the actuator 270. In such case, an activation input is not provided to the shape memory material member 820. For instance, when the shape memory material member 820 is one or more shape memory material wires, an activation input (e.g., electrical current) to heat the wires is not provided. Thus, the shape memory material member 820 is in a neutral or non-activated condition. In the non-activated configuration, the central portion 806 of the sheet 800 can be substantially flush with the inner peripheral surface 122 of the housing 120.

FIG. 8B shows an example of an activated mode of the actuator 270. In the actuated mode, an activation input can be provided to the shape memory material member 820. As a result, the shape memory material member 820 can contract. This contraction causes the shape memory material member 820 to pull the connected portions of the sheet 800 toward each other. As a result, the sheet 880 can bow or extend outward so as to increase in overall height (i.e., in the top to bottom direction of the page in FIGS. 8A and 8B). It will be appreciated that, when the activation input is discontinued, the shape memory material member 820 can substantially returns to a neutral or non-activated configuration, such as shown in FIG. 8A, due to an inherent spring-back or compliant of the sheet 800. As a result, the inner peripheral surface 122 will also return to its non-activated configuration.

It should be noted that, in some arrangements, the shape memory material member 820 can be one or more straight wires. Alternatively, the shape memory material member 820 can be one or more wires arranged in a serpentine manner (which would span into and out of the page in FIGS. 8A and 8B).

The shape memory material member 820 can be made of a material that changes shape when an activation input is provided to the shape memory material and, when the activation input is discontinued, the material substantially returns to its original shape. Examples of shape memory materials include shape memory alloys (SMA) and shape memory polymers (SMP).

In one or more arrangements, the shape memory material member 820 can be a shape memory material wire. Thus, when an activation input (i.e., heat) is provided to the shape memory alloy wire, the wire can contract. The shape memory alloy wire can be heated in any suitable manner, now known or later developed. For instance, the shape memory alloy wire can be heated by the Joule effect by passing electrical current through the wires. In some instances, arrangements can provide for cooling of the shape memory alloy wire, if desired, to facilitate the return of the wires to a non-activated configuration.

The wires can be made of any suitable shape memory material, now known or later developed. Different materials can be used to achieve various balances, characteristics, properties, and/or qualities. As an example, an SMA wire can include nickel-titanium (Ni—Ti, or nitinol). One example of a nickel-titanium shape memory alloy is FLEXINOL, which is available from Dynaolloy, Inc., Irvine, Calif. As further example, the SMA wires can be made of Cu—Al—Ni, Fe—Mn—Si, or Cu—Zn—Al. Additionally, different physics may be employed to actuate the shape memory material. As a non-limiting example, magnetic shape memory alloys (such as Ni—Mn—Ga) may be employed as a shape memory wire or structural element.

The SMA wires or structural elements can be configured to increase or decrease in length upon changing phase, for example, by being heated to a phase transition temperature or subjected to a magnetic field. Utilization of the intrinsic property of SMA wires can be accomplished by using heat, for example, via the passing of an electric current through the SMA wire in order provide heat generated by electrical resistance, in order to change a phase or crystal structure transformation (i.e., twinned martensite, detwinned martensite, and austentite) resulting in a lengthening or shortening the SMA wire. Similar effects may be achieved using magnetic fields with different alloys.

Other active materials may be used in connected with the arrangements described herein. For example, other shape memory materials may be employed. Shape memory materials, a class of active materials, also sometimes referred to as smart materials, include materials or compositions that have the ability to remember their original shape, which can subsequently be recalled by applying an external stimulus, such as an activation signal.

While the shape memory material member 820 is described, in one implementation, as being one or more wires, it will be understood that the shape memory material member 820 is not limited to being wires. Indeed, it is envisioned that suitable shape memory materials may be employed in a variety of other forms, such as strips, small sheets or slabs, cellular and lattice structures, helical or tubular springs, braided cables, tubes, or combinations thereof. In some arrangements, the shape memory material member 820 may include an insulating coating.

Now that the various potential systems, devices, elements and/or components of the system 100 have been described, various methods will now be described. Various possible steps of such methods will now be described. The methods described may be applicable to the arrangements described above in relation to FIGS. 1-8, but it is understood that the methods can be carried out with other suitable systems and arrangements. Moreover, the methods may include other steps that are not shown here, and in fact, the methods are not limited to including every step shown. The blocks that are illustrated here as part of the methods are not limited to the particular chronological order. Indeed, some of the blocks may be performed in a different order than what is shown and/or at least some of the blocks shown can occur simultaneously.

Figure 9:
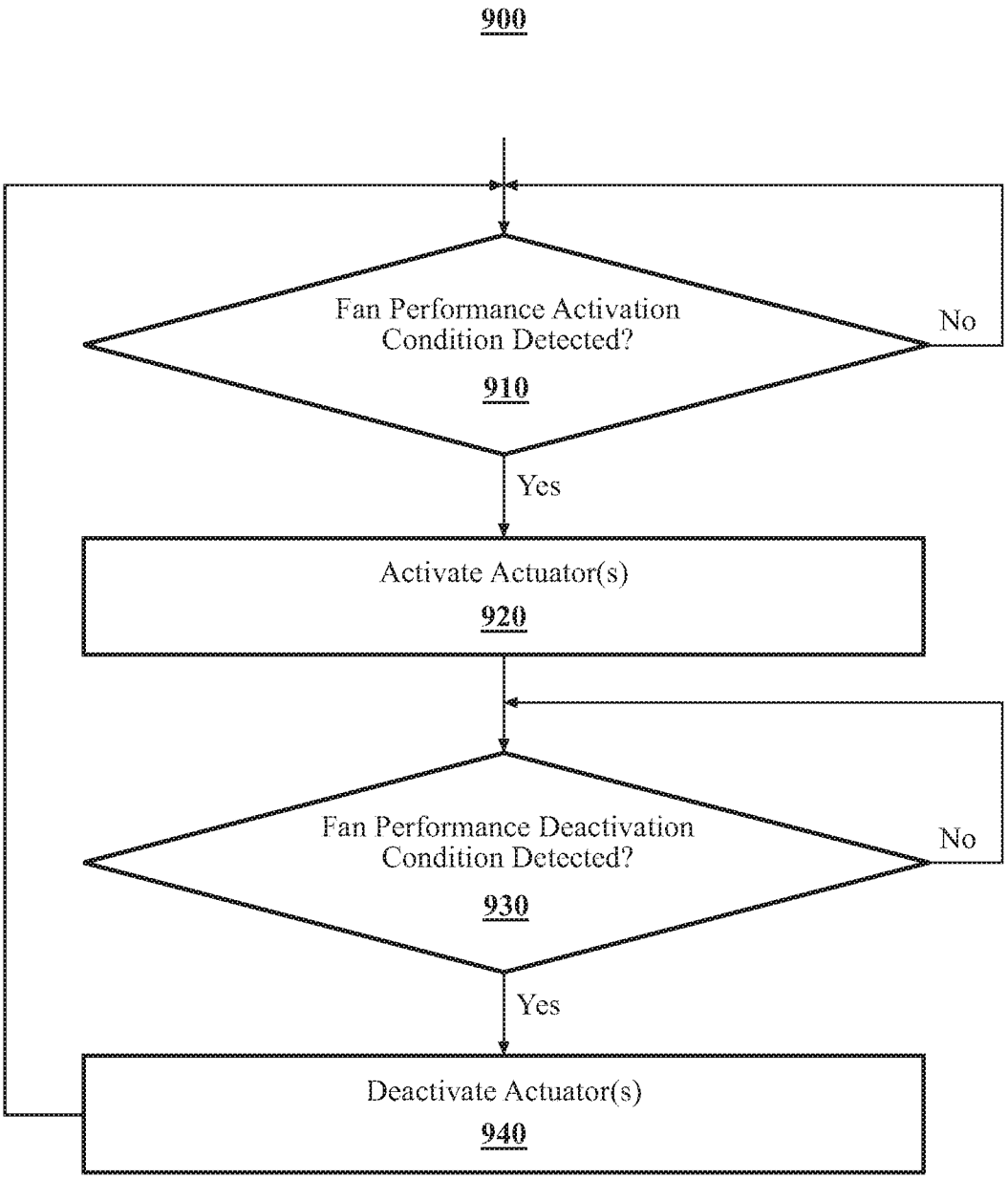
FIG. 9 is an example of a method of fan performance tuning.

Turning to FIG. 9, an example of a method 900 is shown. For the sake of discussion, the method 900 can begin with the actuators 270 in a non-activated mode, such as is shown in FIG. 6A, 7A, or 8A. In the non-activated mode, electrical energy from the power source(s) 240 is not supplied to the actuators 270. At block 910, it can be determined whether a fan performance activation condition has been detected. The fan performance activation condition may be detected by the fan performance module(s) 280, the processor(s) 210, and/or one or more sensor(s) 230. For instance, the fan performance module(s) 280, the processor(s) 210, and/or the sensor(s) 230 can determine whether data acquired by the sensor(s) 230 meets a fan performance activation condition. For instance, the fan performance module(s) 280, the processor (s) 210, and/or the sensor(s) 230 can determine whether the current acoustic properties and/or fluid flow properties of the fan system 110 meet respective fan performance activation threshold. For instance, the fan performance module(s) 280, the processor(s) 210, and/or the sensor(s) 230 can determine whether there are any undesired noises in the fan system 110. Alternatively or in addition, the fan performance module(s) 280, the processor(s) 210, and/or one or more sensor (s) 230 can detect a user input indicating that the interface should be activated. The user input can be provided via the input interface(s) 250.

If a fan performance activation condition is not detected, the method 900 can end, return to block 910, or proceed to some other block. However, if a fan performance activation condition is detected, then the method can proceed to block 920. At block 920, the actuators 270 can be activated. Of course, the fan performance module(s) 280 and/or the processor(s) 210 may only actuate certain individual actuators 270 while leaving others in a non-activated state. Thus, the fan performance module(s) 280 and/or the processor(s) 210 can cause or allow the flow of electrical energy from the power sources(s) 240 to the actuators 270.

Using the actuators in FIG. 6A or 7A as an example, the first conductor 650 and the second conductor 660 can become oppositely charged, which causes them to attract each other. When activated, the actuators 270 can morph to an activated shape, such as is shown in FIG. 6B or 7B. With respect to the actuator 270 shown in FIG. 8A, the shape memory material member 820 can be heated or a magnetic field can be applied. As a result, the shape memory material member 820 can contract, which causes the actuator 270 to morph into an activated shape, such as is shown in FIG. 8B.

Based on the orientation and/or configuration of the actuators 270, the overall height of the actuators 270 will increase in the radially inward direction of the housing 120. As a result, the inner peripheral surface 122 of the housing 120 will change at the location of the actuators 270. More particularly, the inner diameter of the inner peripheral surface 122 of the housing 120 will decrease. The activated actuators 270 can be associated with the first portion 130 and/or the second portion 140 of the inner peripheral surface 122, or they can be associated with some other portion of the inner peripheral surface 122. It will be appreciated that, when the actuators 270 are activated, one or more performance characteristics of the fan system 110, such as acoustic performance and/or flow performance, will be altered. The method can continue to block 930.

At block 930, it can be determined whether a fan performance deactivation condition has been detected. The fan performance deactivation condition may be detected by the fan performance module(s) 280, such as based on data acquired by the sensor(s) 230 and/or by detecting a user input or the cessation of a user input. If a fan performance deactivation condition is not detected, the method 500 can return to block 930, or proceed to some other block. However, if a fan performance deactivation condition is detected, then the method can proceed to block 940.

At block 940, the actuators 270 can be deactivated. Thus, the fan performance module(s) 280 and/or the processor(s) 210 can cause the flow of electrical energy from the power sources(s) 240 to the actuators 270 to be discontinued. As a result, the actuators 270 can substantially return to their non-activated configurations, such as shown in FIG. 6A, 7A, or 8A. As a result, the inner peripheral surface 122 of the housing 120 will change at the location of the actuators 270. More particularly, the inner diameter of the inner peripheral surface 122 of the housing 120 will increase and can become substantially flush with the neighboring portions of the inner peripheral surface 122 of the housing. It will be appreciated that, when the actuators 270 are deactivated, one or more performance characteristics of the fan system 110, such as acoustic performance and/or flow performance, will be altered.

The method 900 can end. Alternatively, the method 900 can return to block 910 or some other block.

It will be appreciated that arrangements described herein can provide numerous benefits, including one or more of the benefits mentioned herein. For example, arrangements described herein can allow for a variable interface that can be adjusted as needed depending on current conditions. Arrangements described herein can allow for the automatic tuning of the shape and/or size of a gap between the rotating blades and the stationary housing to optimize fan performance and/or acoustic properties. Arrangements described herein can allow for optimized fan operation at many different speeds by tuning the size of the air gap. Arrangements described herein can facilitate the use of one type of fan in many different applications. Arrangements described herein can avoid the use of large and complicated gears and actuators, thereby enabling more compact designs and packaging.

The flowcharts and block diagrams in the figures illustrate the architecture, functionality, and operation of possible implementations of systems, methods and computer program products according to various embodiments. In this regard, each block in the flowcharts or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved.

The systems, components and/or processes described above can be realized in hardware or a combination of hardware and software and can be realized in a centralized fashion in one processing system or in a distributed fashion where different elements are spread across several interconnected processing systems. Any kind of processing system or other apparatus adapted for carrying out the methods described herein is suited. A typical combination of hardware and software can be a processing system with computer-usable program code that, when being loaded and executed, controls the processing system such that it carries out the methods described herein. The systems, components and/or processes also can be embedded in a computer-readable storage, such as a computer program product or other data programs storage device, readable by a machine, tangibly embodying a program of instructions executable by the machine to perform methods and processes described herein. These elements also can be embedded in an application product which comprises all the features enabling the implementation of the methods described herein and, which when loaded in a processing system, is able to carry out these methods.

Furthermore, arrangements described herein may take the form of a computer program product embodied in one or more computer-readable media having computer-readable program code embodied or embedded, e.g., stored, thereon. Any combination of one or more computer-readable media may be utilized. The computer-readable medium may be a computer-readable signal medium or a computer-readable storage medium. The phrase "computer-readable storage medium" means a non-transitory storage medium. A computer-readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer-readable storage medium would include the following: an electrical connection having one or more wires, a portable computer diskette, a hard disk drive (HDD), a solid state drive (SSD), a random access memory (RAM), a read-only memory (ROM), an erasable programmable read-only memory (EPROM or Flash memory), an optical fiber, a portable compact disc read-only memory (CD-ROM), a digital versatile disc (DVD), an optical storage device, a magnetic storage device, or any suitable combination of the foregoing. In the context of this document, a computer-readable storage medium may be any tangible medium that can contain, or store a program for use by or in connection with an instruction execution system, apparatus, or device.

Program code embodied on a computer-readable medium may be transmitted using any appropriate medium, including but not limited to wireless, wireline, optical fiber, cable, RF, etc., or any suitable combination of the foregoing. Computer program code for carrying out operations for aspects of the present arrangements may be written in any combination of one or more programming languages, including an object oriented programming language such as Java™, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e. open language). The phrase "at least one of . . . and . . . " as used herein refers to and encompasses any and all possible combinations of one or more of the associated listed items. As an example, the phrase "at least one of A, B and C" includes A only, B only, C only, or any combination thereof (e.g., AB, AC, BC or ABC).

As used herein, the term "substantially" or "about" includes exactly the term it modifies and slight variations therefrom. Thus, the term "substantially parallel" means exactly parallel and slight variations therefrom. "Slight variations therefrom" can include within 10 degrees/percent/units or less, within 9 degrees/percent/units or less, within 8 degrees/percent/units or less, within 7 degrees/percent/units or less, within 6 degrees/percent/units or less, within 5 degrees/percent/units or less, within 4 degrees/percent/units or less, within 3 degrees/percent/units or less, within 2 degrees/percent/units or less, or within 1 degree/percent/unit or less. In some instances, "substantially" can include being within normal manufacturing tolerances.

Aspects herein can be embodied in other forms without departing from the spirit or essential attributes thereof. Accordingly, reference should be made to the following claims, rather than to the foregoing specification, as indicating the scope of the invention.

What is claimed is:

1. A system for fan performance tuning, the system comprising:

a fan including a plurality of blades operatively connected to a rotor, the plurality of blades extending radially outward from the rotor to a tip;

a housing substantially surrounding the plurality of blades, the housing defining an inner peripheral surface and having an inner diameter, the inner peripheral surface including a first portion and a second portion, the first portion being upstream of the second portion relative to a fluid flow direction of the fan, the first portion being adjacently upstream of the plurality of blades, and the second portion being substantially aligned with the plurality of blades, the inner diameter being alterable at the first portion and at the second portion; and a plurality of actuators being distributed in a circumferential direction of the housing, the plurality of actuators being operatively positioned to cause the inner diameter of the housing at the first portion or the second portion to be altered, whereby one or more performance characteristics of the fan are changed.

2. The system of claim 1, wherein the plurality of actuators includes a first plurality of actuators and a second plurality of actuators, wherein the first plurality of actuators are operatively positioned to cause the inner diameter of the housing at the first portion to be altered, and wherein the second plurality of actuators are operatively positioned to cause the inner diameter of the housing at the second portion to be altered.

3. The system of claim 1, wherein the plurality of actuators are configured to independently alter the first portion and the second portion.

4. The system of claim 1, further including:

one or more processors; and one or more power sources operatively connected to the plurality of actuators, the one or more processors being operatively connected to control a supply of electrical energy from the one or more power sources to the plurality of actuators.

5. The system of claim 4, further including:

one or more sensors operatively connected to the one or more processors, the one or more sensors being configured to acquire fan operating environment data, and wherein the plurality of actuators are selectively activated or deactivated based at least partially on fan operating environment data acquired by the one or more sensors.

6. The system of claim 5, wherein the one or more sensors includes one or more microphones or pressure transducers, and wherein the fan operating environment data includes acoustic data.

7. The system of claim 5, wherein the one or more sensors includes one or more fluid flow and temperature sensors, and wherein the fan operating environment data includes fluid flow and temperature data.

8. The system of claim 4, further including:

an input interface, the input interface being operatively connected to the one or more processors, wherein the plurality of actuators are selectively activated or deactivated responsive to a user input provided on the input interface.

9. The system of claim 1, wherein the first portion and the second portion of the inner peripheral surface are defined by a flexible or compliant material.

10. The system of claim 1, wherein, when the plurality of actuators are not activated, the first portion and the second portion are substantially flush with adjacent portions of the inner peripheral surface.

11. The system of claim 1, wherein each of the plurality of actuators includes:

a bladder, the bladder including a flexible casing and defining a fluid chamber, the fluid chamber including a dielectric fluid; and a first conductor and a second conductor operatively positioned on opposite portions of the bladder, each of the plurality of actuators being configured such that, when electrical energy is supplied to the first conductor and the second conductor, the first conductor and the second conductor have opposite charges, whereby the first conductor and the second conductor are electrostatically attracted toward each other to cause at least a portion of the dielectric fluid to be displaced to a region of the fluid chamber such that an overall height of the actuator increases.

12. The system of claim 1, wherein each of the plurality of actuators includes a shape memory material member, and wherein, when an activation input is provided to the shape memory material member, the shape memory material member contracts to cause the actuator to morph into an activated configuration.

13. A method of fan performance tuning, a fan includes a plurality of blades operatively connected to a rotor, the plurality of blades extend radially outward from the rotor to a tip, a housing substantially surrounds the plurality of blades, the housing defines an inner peripheral surface and has an inner diameter, the inner peripheral surface includes a first portion and a second portion, the first portion is adjacently upstream of the plurality of blades, the second portion is substantially aligned with the plurality of blades, and the inner diameter being alterable at the first portion and at the second portion, the method comprising:

detecting a fan performance activation condition; and responsive to detecting a fan performance activation condition, activating one or more of a plurality of actuators to cause the inner diameter of the housing at the first portion or the second portion to decrease, whereby one or more performance characteristics of the fan are changed.

14. The method of claim 13, wherein detecting a fan performance activation condition includes:

acquiring, using one or more sensors, fan operating environment data;

comparing the acquired fan operating environment data to one or more fan performance activation condition thresholds; and if the acquired fan operating environment data meets the one or more fan performance activation condition thresholds, then a fan performance activation condition is detected.

15. The method of claim 14, wherein the one or more sensors includes one or more microphones, wherein the fan operating environment data includes acoustic data, and wherein the one or more fan performance activation condition thresholds includes a fan acoustic threshold.

16. The method of claim 14, wherein the one or more sensors includes one or more fluid flow sensors, wherein the fan operating environment data includes fluid flow data, and wherein the one or more fan performance activation condition thresholds includes a fluid flow threshold.

17. The method of claim 13, wherein detecting a fan performance activation condition includes receiving an input on a user interface indicative of activation or deactivation of the plurality of actuators.

18. The method of claim 13, wherein each of the plurality of actuators includes:

a bladder, the bladder including a flexible casing and defining a fluid chamber, the fluid chamber including a dielectric fluid; and a first conductor and a second conductor operatively positioned on opposite portions of the bladder, each of the plurality of actuators being configured such that, when electrical energy is supplied to the first conductor and the second conductor, the first conductor and the second conductor have opposite charges, whereby the first conductor and the second conductor are electrostatically attracted toward each other to cause at least a portion of the dielectric fluid to be displaced to a region of the fluid chamber such that an overall height of the actuator increases.

19. The method of claim 13, wherein each of the plurality of actuators includes a shape memory material member, and wherein, when an activation input is provided to the shape memory material member, the shape memory material member contracts to cause the actuator to morph into an activated configuration.

20. The method of claim 13, further including:

detecting a fan performance activation deactivation condition; and responsive to detecting a fan performance activation deactivation condition, deactivating one or more of the plurality of actuators to cause the inner diameter of at least one of the first portion or the second portion to increase, whereby one or more performance characteristics of the fan are changed.

* * * * *